US006209271B1

(12) United States Patent
Kovacs

(10) Patent No.: US 6,209,271 B1
(45) Date of Patent: Apr. 3, 2001

(54) SAFETY SCREEN WITH A GUARD ASSEMBLY HAVING THREE FLANGED MOUNTING MEMBERS

(76) Inventor: John C. Kovacs, 10223 Vernlyn, San Antonio, TX (US) 78230

( * ) Notice: Subject to any disclaimer, the term of this patent is extended or adjusted under 35 U.S.C. 154(b) by 0 days.

(21) Appl. No.: 09/405,778

(22) Filed: Sep. 27, 1999

Related U.S. Application Data

(60) Provisional application No. 60/110,237, filed on Nov. 30, 1998.

(51) Int. Cl.[7] ..... E04B 7/18; E06B 3/68; E06B 9/01

(52) U.S. Cl. ..... 52/200; 52/202; 52/204.62; 52/106; 49/50

(58) Field of Search ..... 52/200, 202, 781.3, 52/204.62, 72, 106; 49/50, 61, 57

(56) References Cited

U.S. PATENT DOCUMENTS

D. 354,817 * 1/1995 Kovacs et al. ..... D25/53
4,428,169 * 1/1984 Tsakiris ..... 52/200
4,571,897 * 2/1986 Kerr ..... 52/13
5,237,788 * 8/1993 Sandow ..... 52/200
5,502,934 * 4/1996 Coyne et al. ..... 52/200
5,664,384 * 9/1997 Cullinan ..... 52/507
5,669,186 * 9/1997 Verby et al. ..... 52/72

FOREIGN PATENT DOCUMENTS

2125864 * 9/1972 (FR) ..... 52/200
777177 * 11/1980 (SU) ..... 52/200

* cited by examiner

*Primary Examiner*—Daniel P. Stodola
*Assistant Examiner*—Gregory J. Strimbu
(74) *Attorney, Agent, or Firm*—Jackson Walker L.L.P.

(57) ABSTRACT

A guard assembly for a framed opening in a structure includes mounting brackets attached to the framed opening. Each bracket has three angled flanges forming an intersection channel for retaining a grid work member extending between the mounting brackets. The grid work member is compressively urged into the intersection channels and further secured by locking screws extending through one of the angled flanges.

4 Claims, 2 Drawing Sheets

SAFETY SCREEN WITH A GUARD ASSEMBLY HAVING THREE FLANGED MOUNTING MEMBERS

This application claims priority to co-pending U.S. Provisional Patent Application Ser. No. 60/110,237, filed Nov. 30, 1998.

BACKGROUND OF THE INVENTION

The present invention relates to a safety screen for skylights, roof openings, and the like. More particularly, the present invention relates to an improved mounting bracket system for securing the screening material in the proper position around the opening or skylight.

The Occupational Safety and Health Act (OSHA) general industry standards require that every skylight floor opening and hole shall be guarded by a standard skylight screen or a fixed standard railing on all exposed sides. The skylight screens must be capable of withstanding a load of at least 200 pounds applied perpendicularly at any one area of the screen. The construction of the grill work with openings must be not more than four inches long or of slat work with openings not more than two inches wide with length unrestricted. These limitations strictly limit the construction alternatives available.

U.S. Pat. Nos. Des. 354,817 and 5,237,788 illustrate existing skylight screens which comply with OSHA's strict requirements. Working on roof openings normally occurs in hard to reach locations or in close confines. It is extremely difficult to assemble multiple piece assemblies in these locations. U.S. Pat. No. 5,237,788 is extremely complex in its construction and requires considerable expense to construct. It is particularly difficult to assemble.

U.S. Patent No. Des. 354,817 provides a good, safe construction but requires welding skills to permanently secure the grid work to the side brackets. Again, placement and use of welding equipment at the work site makes attachment difficult.

The present invention is less costly to manufacture and requires only a wrench and screw driver to safely mount the screen over a skylight. It should therefore be understood that the present invention is a considerable improvement in the art.

SUMMARY OF THE INVENTION

The present invention is a guard assembly for a framed opening in a structure such as a skylight or other roof-top access. The assembly uses two, spaced-apart, ti-flanged mounting brackets for securing a grid work spanning the opening. A first flange depends downwardly along the side of the opening frame; a second, horizontal, flange rests on top of the frame upon assembly; and, a third flange extends upwardly at an angle less than 90° to the horizontal. The intersection of the second and third flange forms a channel which accepts and retains the grid work. The grid work is compressively urged into opposing channels affixed along the opening frame and retaining screws extend through the third flange to further secure the grid work.

The assembly may be retained on the structural framing by use of extended attachment rods or may be affixed directly to the frame with standard fasteners. The assembly meets all OSHA requirements for skylights and may be accomplished with a minimum of equipment in a reduced workspace.

DETAILED DESCRIPTION OF THE PREFERRED EMBODIMENT

Figure 1:
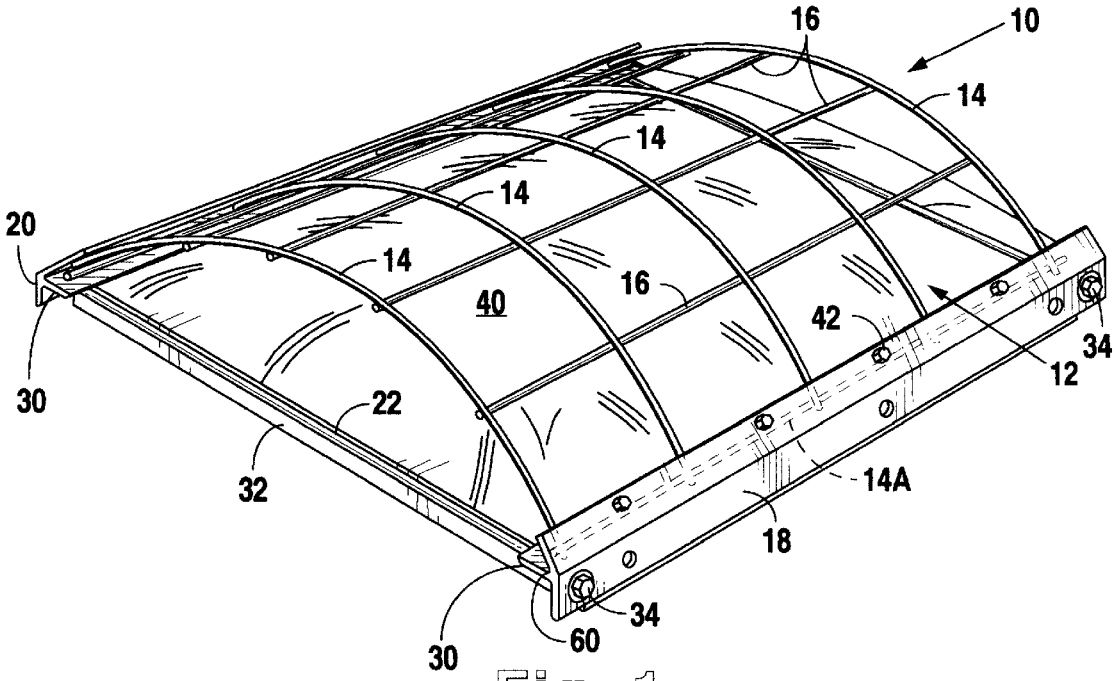
FIG. 1 is a front, top, left side perspective view of the present invention.

FIG. 1 illustrates a perspective view of the present guard assembly 10, having a grid work 12 of wire mesh or screen. A plurality of parallel, spaced-apart, transverse bars 14 are attached to a plurality of parallel, spaced-apart longitudinal bars 16 to form the grid.

Grid work 12 compressively is retained in and connects to mounting brackets 18 and 20 as will be described in detail below. Brackets 18 and 20 are further joined by attachment rods 22 and 24 (FIG. 2) on opposite ends of the brackets. By setting the underside 32B (FIG. 3A) of horizontal flanges 30 on the skylight frame 32 and tightening nuts 34, the guard assembly 10 is tightly affixed and retained on the frame 32 with rods 22 extending along the outer sides of frame 32. The grid work 12 is compressively urged into channels 60 in brackets 18 and 20 and arcuatedly extends above the skylight 40 as required by OSHA standards.

Figure 2:
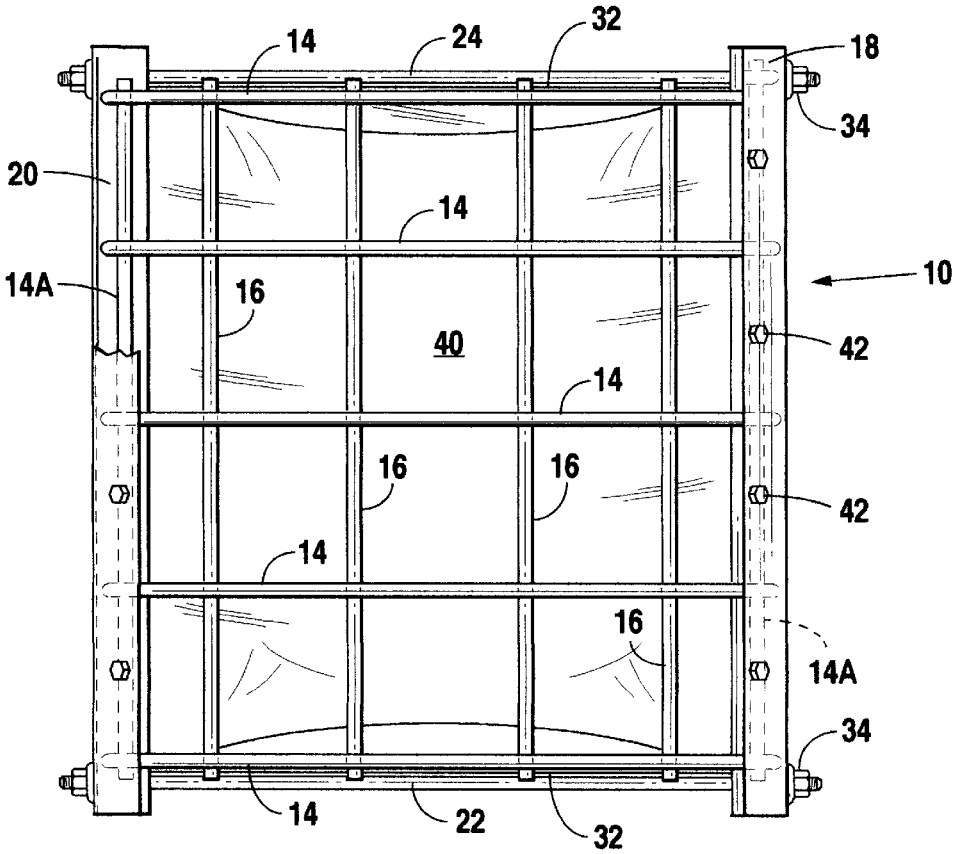
FIG. 2 is a top plan view of the present invention with a partial cut-away of the left upper flange.
Figure 3:
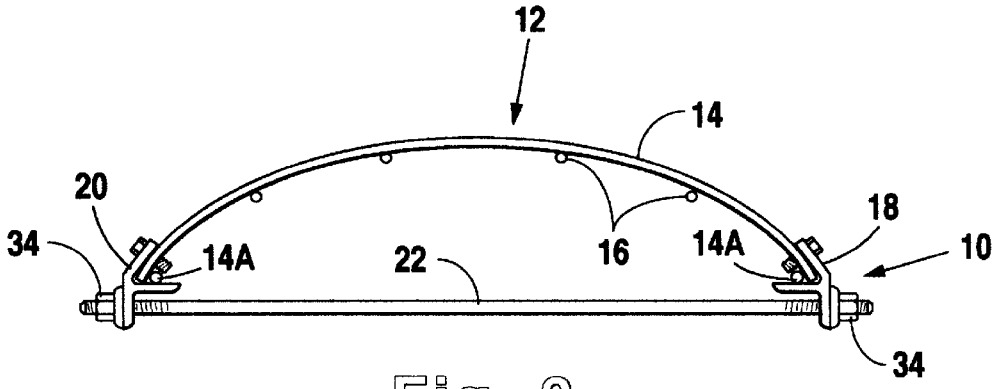
FIG. 3 is a side elevation view of the present invention with attachment rod.

FIG. 2 shows a top view of the guard assembly 10 mounted on frame 32 of skylight 40. FIG. 3 illustrates a side elevation view of guard assembly 10 without the skylight.

Figure 3A:
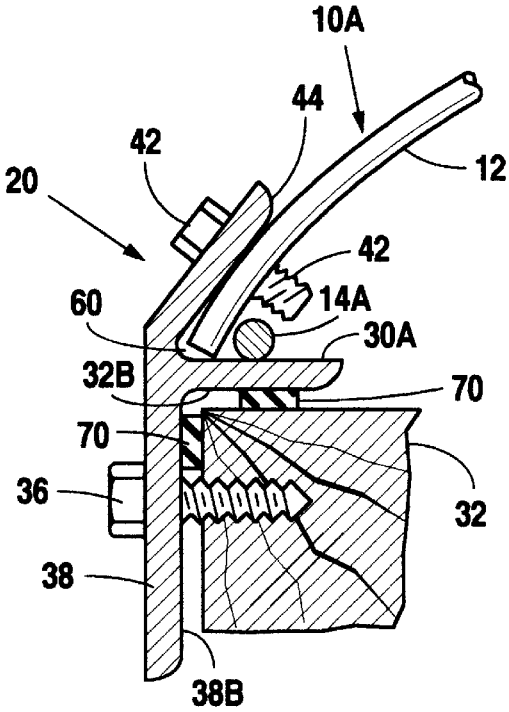
FIG. 3A illustrates a cross sectional view of the present invention mounted directly to the skylight framing.

FIG. 3A illustrates an alternative embodiment 10A of the assembly. Rather than using attachment rods 22, the mounting brackets 18 or 20 are directly attached to the frame 32. Fasteners 36 pass through openings 50 (FIG. 4) in the downwardly depending flanges 38 of the bracket 20 and into frame 32.

It may be further seen in FIG. 3A that the end longitudinal bar 14A rests on the top side 30A of horizontal flange 30. A retaining screw or locking member 42 extends through an opening 62 (FIG. 4) in upwardly extending flange 44 above bar 14A to further secure the grid work 12 in channel 60.

Seals 70 may be placed between the underside 32B of horizontal flange 30 and frame 32 and inside surface 38B of downward depending flange 38 and frame 32.

Figure 4:
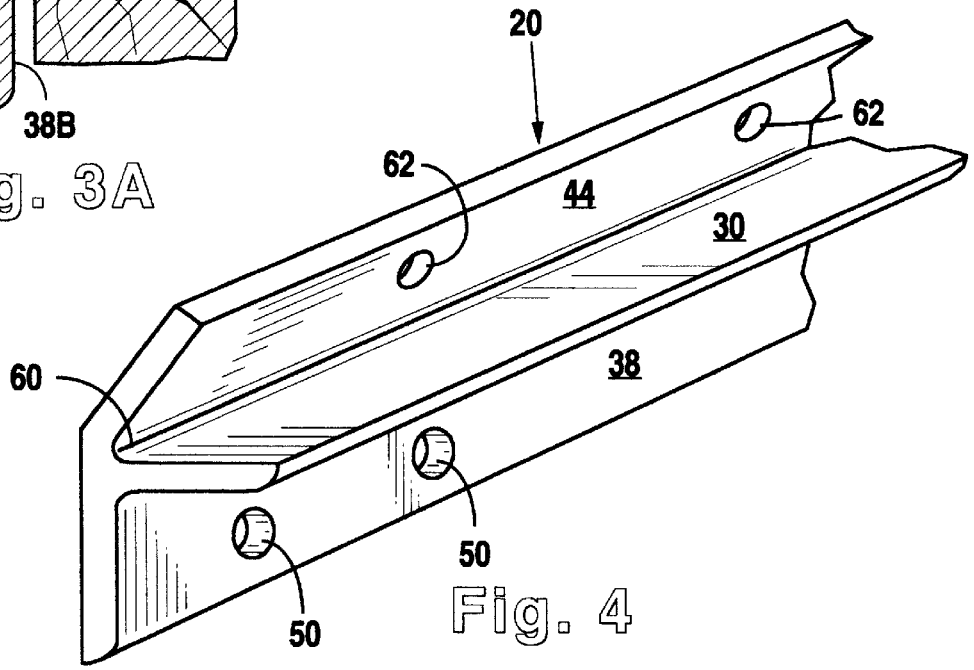
FIG. 4 is a perspective view of a section of the improved mounting bracket of the present invention.

FIG. 4 illustrates the improved mounting brackets 18 and 20 of the present invention. A first downwardly depending flange or leg 38 is connected at a generally 90° or perpendicular angle to second horizontal flange 30. A third upwardly extending flange 44 extends at an angle of less than 90° but greater than 20° to the second horizontal flange 30. Openings 62 in the third flange 44 are adapted to retain locking members or retaining screws 42 to hold grid work 12 in the intersection or channel 60 formed between the second flange 30 and the third flange 44.

Openings 50 in the first flange 38 are available to accept attachment rods 22 or fasteners 36 depending on the embodiment. The mounting brackets are made of extruded lightweight aluminum.

Again, it should be understood that the present invention may be utilized by attaching the mounting brackets directly to the framing material 32. In this manner each of the brackets may be attached and sealed against the frame as shown in FIG. 3A. Then the grid work 12 is urged into the channels 60 on each side. The flexibility of the grid work 12 allows for this compressive force to retain the grid work in the brackets. Additional security is provided by the use of locking fasteners 42.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A guard assembly for a framed opening in a structure comprising:

a means for mounting a grid work member to said framed opening, said mounting means further comprising:

downwardly depending first flanges, said first flanges having attachment openings;

second flanges extending generally perpendicularly from said first flanges; and third flanges extending upwardly from said second flanges at an angle less than 90° from said second flanges;

said grid work member connecting a first portion of said mounting means to a second portion of said mounting means and spanning a space between said first and said second portions, said space approximately as wide as said opening in said structure, said grid work member compressively urging into a intersections of said second flanges and said third flanges to secure said grid work member to said mounting means; and locking members additionally securing said grid work member to said mounting means, said locking members extending through said third flanges into channels between said second flanges and said third flanges.

2. The assembly of claim 1 wherein said angle is between 90° and 20°.

3. The assembly of claim 1 wherein said angle is generally 60° to generally 40°.

4. The assembly of claim 1 wherein said mounting means further comprises attachment rods releasably extending between and interconnecting said first flanges.

* * * * *